US007204326B2

(12) United States Patent
Downie et al.

(10) Patent No.: US 7,204,326 B2
(45) Date of Patent: Apr. 17, 2007

(54) DRILLING TURBINE

(75) Inventors: Andrew McPherson Downie, Fife (GB); Guido Ernesto Pezzani, Clackmannanshire (GB); Edward Docherty Scott, Fife (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/639,826

(22) Filed: Aug. 13, 2003
(Under 37 CFR 1.47)

(65) Prior Publication Data

US 2004/0200642 A1 Oct. 14, 2004

Related U.S. Application Data

(63) Continuation of application No. 10/312,132, filed as application No. PCT/GB01/02753 on Jun. 20, 2001, now abandoned.

(30) Foreign Application Priority Data

Jun. 21, 2000 (GB) ..... 0015207.4

(51) Int. Cl.
*E21B 4/02* (2006.01)

(52) U.S. Cl. ..... 175/107; 416/241 A; 416/241 B; 415/903; 415/200; 415/199.4; 415/901

(58) Field of Classification Search ..... 175/107, 175/92; 416/241 A, 241 B; 415/903, 200, 415/199.4, 199.5, 901
See application file for complete search history.

(56) References Cited

U.S. PATENT DOCUMENTS

| | | | | |
|---|---|---|---|---|
| 3,346,175 | A * | 10/1967 | Wiles | 415/200 |
| 3,628,890 | A * | 12/1971 | Sayre et al. | 416/241 A |
| 3,854,843 | A * | 12/1974 | Penny | 416/241 B |
| 3,883,267 | A * | 5/1975 | Baudier et al. | 416/241 A |
| 4,114,702 | A | 9/1978 | Maurer et al. | |
| 4,832,573 | A | 5/1989 | Dorski | |
| 4,850,818 | A | 7/1989 | Kotera | |
| 6,230,823 | B1 * | 5/2001 | Sieniawski | 175/107 |

FOREIGN PATENT DOCUMENTS

RU 1774982 A3 11/1992

(Continued)

OTHER PUBLICATIONS

International Search Report for International Application No. PCT/GB01/02753 completed Oct. 10, 2001.

(Continued)

*Primary Examiner*—David Bagnell
*Assistant Examiner*—Matthew J. Smith
(74) *Attorney, Agent, or Firm*—Alston & Bird LLP

(57) ABSTRACT

A turbine is disclosed which includes a turbine blade housing having an inner facing portion of a first material having a first coefficient of expansion, and a turbine blade body having an outer facing portion of a second coefficient of expansion greater than said first coefficient. In a preferred embodiment, the blade housing comprises a number of steel shroud rings and the turbine blade body comprises a number of stators and rotors of a thermoplastic material. An interference fit between stator blades and the shroud rings is enhanced in use due to the difference in thermal and/or hydrophilic coefficients of expansion of the first and second materials.

23 Claims, 3 Drawing Sheets

FOREIGN PATENT DOCUMENTS

| | | |
|---|---|---|
| SU | 111795 | 8/1958 |
| SU | 203586 | 12/1967 |
| SU | 1177433 A | 9/1985 |

OTHER PUBLICATIONS

Encyclopaedia of Polymers, 1974, pp. 821-824, vol. 2, Moscow, Sovietskaya Encyclopaedia Publishers.

Orlov, P.I., "Basics of Designing", *Book of References and Educational Aid*, 1988, vol. 1, pp. 134-135, 236-237, and 454-455, Machinostryeni'ye Publishers, Moscow.

*Polytechnical Dictionary*, 1989, p. 384, definition of Plastic Masses.

* cited by examiner

DRILLING TURBINE

CROSS-REFERENCE TO RELATED APPLICATIONS

This application is a continuation of U.S. application Ser. No. 10/312,132 filed Dec. 19, 2002, now abandoned which was a national stage filing under 35 U.S.C. 371 of PCT/GB01/02753 filed Jun. 20, 2001, which International Application was published by the International Bureau in English on Jan. 3, 2002, and both of which are incorporated herein by reference.

BACKGROUND OF THE INVENTION

1) Field of the Invention

The present invention relates to a turbine. In particular, but not exclusively, the present invention relates to a turbine such as a turbine for a drilling assembly; a drilling assembly including a turbine; and an at least partly polymeric rotor and stator for use in a turbine.

2) Description of Related Art

In the field of, for example, oilfield exploration, "Turbo-drilling" is an established method of creating a "bore-hole" by drilling through geological strata. Turbo-drilling machines, as the descriptive name implies, are turbines powered by either an "impulse" or "reaction" type turbine blade system. Impulse type systems are ones which are driven by a fluid at atmospheric pressure, whilst reaction type systems are ones driven by fluid pressurised to above atmospheric pressure, possessing energy which is partly kinetic and partly pressure.

Further, turbine blade systems of the reaction type are ones where the blade profile of the stator and rotor is essentially an aerodynamic profile, subject to the "Bernoulli principle" of different pressure being created by a fluid passing over two opposite exterior surfaces of a common body. Where these surface lengths are different, this creates areas of high pressure on one surface and low pressure on the opposite surface, this creating a pressure differential which results in a movement of the body towards the low pressure side of the body.

This principle is used in turbo-drills to transfer the hydraulic power of a drilling fluid being pumped through the turbine system of stators and rotors into rotational power of a rotor element, which is rigidly attached to a drive shaft system, and ultimately connected to a drilling bit (which may be one of various designs and configurations) for the explicit purpose of fracturing a rock structure. The drilling fluid having exited the drilling machine is further utilised for the removal of drilling cuttings by being transported in suspension to the surface up the annulus of the borehole for disposal.

The art of generating power from a turbine system is well known and there are many forms of turbine systems being employed in various engineering fields. In these various fields, there are problems associated with blade life, for example, degradation of the aerofoil shape of the turbine blade leading to reduced efficiency of the blade system.

In the field of oilwell drilling, the majority of drilling is accomplished with the aid of a drilling fluid, typically mud (as noted above), air or more recently foam, this fluid being utilised for control of the well bore and transportation of rock cuttings. Drilling mud is a suspension of barites in an oil or water based solution of various densities. Drilling foam is generally used in under-balanced drilling applications normally associated with high velocity flow systems, whilst air is used in high speed drilling applications not normally associated with oilwell drilling.

In all of these drilling fluid systems there is an associated abrasive characteristic of the fluid. This abrasiveness gradually degrades the internal components of the drilling machine, which abrasive wear is known as "erosion", where the rate of erosion is related to fluid velocity, drilling fluid density and characteristics of component molecular structures. Generally speaking, high fluid velocities are characteristic of any fluid flowing through a turbine blade system in operation. Steel components are also subjected to "corrosion", related to the chemical composition of the drilling fluid and turbine component molecular structures. This erosion and corrosion can lead to reduced efficiency of a turbine blade system and reduce the life of a turbine drilling system.

Traditionally, the method of manufacture of turbine rotors and stators for oilwell drilling applications is to manufacture the components from steel of various compositions, for example, carbon steels or stainless steels. These steel materials have certain advantages and inherent disadvantages, the main advantage being that the complex shape of the blade profile is readily cast by various methods, for example, the "lost wax" method, or more recently with the introduction of CNC machine tools, the steel can be machined; however this is a costly and time consuming process. Also steels of certain chemical composition can be heat treated to enhance the end product characteristics. Stator and rotor elements are typically constructed as a one piece cast/moulded component or made up from several constituent parts, such as rotor blade hubs, stator blade shrouds and blades.

The selected method of manufacture is generally dependent on the turbine application. In the manufacture of oilwell drilling turbine stators and rotors, the traditional method of manufacture has generally been to produce one piece castings in a steel material for the stator and rotor components, by a casting and finish machining process. The stators and rotors are normally mounted in a tubular body with a drive shaft component, these components being secured by various means to effect a rotation of rotor elements on a drive shaft. Securing of the stator and rotor components can be achieved by mechanical compression or keying systems.

Presently known systems therefore suffer from various disadvantages related to the construction of the systems and limitations of their use due to, in particular, erosion and/or corrosion of components in use.

It is amongst the objects of embodiments of the present invention to obviate or mitigate at least one of the foregoing disadvantages.

BRIEF SUMMARY OF THE INVENTION

According to a first aspect of the present invention, there is provided a turbine including a turbine blade housing having an inner facing surface portion of a first material having a first coefficient of expansion, and a turbine blade body having an outer facing surface portion of a second material of a second coefficient of expansion greater than said first coefficient of expansion, the outer facing surface portion of the turbine blade body being disposed against the inner facing surface portion of the blade housing so as to secure the turbine blade body against rotation with respect to the housing.

The coefficients of expansion may be respective thermal coefficients of expansion or may be respective hydrophilic coefficients of expansion.

The outer facing surface portion of the turbine blade body may comprise one or more of the turbine blades or may comprise a circumferential skirt around a plurality of the blades.

The present invention may therefore provide a turbine wherein the blades of the turbine are mounted in a turbine blade housing in a simple interference fit without any secondary fixings, (such as keys, pins or slots provided in component parts of the turbine), to prevent undesired rotation of the turbine blades with respect to the turbine blade housing. This is particularly advantageous in that it may reduce manufacturing costs and manufacturing time, as the turbine does not require to be constructed to include such secondary fixings, and that it may reduce the time taken to assemble the turbine. The present invention is further advantageous in that it may reduce wear of the turbine blades. For example, where a secondary fixing is provided which is coupled to the turbine blades such that part of the fixing is in the flow path of a driving fluid (such as drilling mud) flowing through the turbine, this may cause the fixing to become worn such that, over time, the coupling of the blades to the housing loosens and the blades are ho longer securely restrained against rotation with respect to the turbine housing. Furthermore, the provision of such a fixing may allow fluid to flow through the turbine blade housing, which is generally undesired in that certain fluids (such as drilling mud) have a tendency to harden and may therefore cause permanent damage to the turbine.

The turbine blade housing may be of a first material comprising a steel, in particular a Nitrided steel or other grade of suitable hardened steel. The turbine blade body may be of a second material comprising an at least partly polymeric material, in particular an at least partly plastic material, for example, a thermoplastic material. Such polymeric materials naturally absorb moisture and therefore may tend to expand in use. In particular, in situations of relatively high pressure, such as are experienced in a downhole environment of an oil/gas well, such materials may absorb relatively greater amounts of moisture. Such moisture may be present in, for example, drilling fluids such as drilling mud or air. Preferably, the turbine blade body is of a second material comprising one of a glass fibre filled nylon (GFFN), a glass fibre filled polyetheretherketone (PEEK) and/or a glass fibre filled polyphenylenesulfide (PPS). The GFFN may include a nylon such as nylon 6 or nylon 66. The advantage of providing a turbine having a turbine body/turbine blades constructed from an at least partly polymeric material is that such materials are able to withstand high velocity impact erosion and eliminate corrosion as a concern for blade components, when compared to materials typically used in the manufacture of turbine blades, such as steels. Such would otherwise, as is known with existing turbine blades, excessively erode or wear the turbine blades whilst fluids such as drilling fluid cause blade corrosion, ultimately requiring the blades to be replaced.

Preferably, the turbine is a fluid driven turbine for a drilling assembly, such as a drilling assembly for use in drilling a borehole of an oil or gas well. The turbine blade body may comprise a ring carrying a plurality of turbine blades.

Preferably, the turbine further comprises a rotor and a stator, each carrying respective turbine blades. The turbine blade body may house the rotor for rotation with respect to the stator. The stator may comprise a stator ring including a tubular blade skirt from which stator turbine blades extend. The stator turbine blades may extend substantially radially outwardly from the blade skirt to be disposed against the inner facing surface portion of the turbine blade housing. It will be understood that the stator turbine blades may therefore be restrained from rotation with respect to the housing.

The rotor may comprise a rotor ring having a blade skirt from which rotor turbine blades extend. The rotor turbine blades may extend substantially radially outwardly from the rotor blade skirt. The rotor may further comprise a rotor hub on which the rotor ring is mounted for rotation therewith. The rotor hub may be coupled to or form part of a turbine drive shaft and the turbine blade body may be provided around the drive shaft. The rotor skirt may be shaped to engage and co-operate with the hub for rotation therewith. Preferably, the rotor skirt includes flats for engaging corresponding flats on the rotor hub, to allow the rotor to be rotated with the rotor hub. The rotor skirt and rotor hub may include co-operating portions which are generally octagonal in cross-section. Preferably, a plurality of stator and rotor rings are provided located alternately along the turbine blade housing.

The turbine may further comprise a turbine body for carrying the turbine blade housing. Preferably, the turbine blade housing comprises a number of tubular shroud rings of the second material. Conveniently, each turbine shroud ring carries a stator and a rotor.

The present invention is particularly advantageous in that the provision of a turbine with a turbine blade housing of a first material and a turbine blade body of a second material of a greater coefficient of expansion provides a turbine wherein, in use, when the turbine experiences elevated operating temperatures, the turbine blade body may seek to expand at a rate greater than that of the turbine blade housing. The turbine blade body may be disposed against the turbine blade housing in an interference fit. This may therefore cause the interference fit with the turbine blade housing to be further enhanced in use, such that the likelihood of the turbine blade body rotating independently of the turbine blade housing becomes further reduced in use, when the turbine experiences such elevated operating temperatures. The natural absorption of moisture, known as hydrophilic absorption, by polymeric materials, noted above, may enhance this effect. References herein to an interference fit between the turbine blade body and the turbine blade housing are to the turbine blade body being located such that the outer facing surface portion of the turbine blade body is brought into a position where it abuts the turbine blade housing, and a compression force is exerted on the turbine blade body by the relatively rigid inner facing surface portion of the turbine blade housing, to secure the turbine blade body against rotation with respect to the housing.

According to a second aspect of the present invention, there is provided a drilling assembly including a turbine as defined in the first aspect of the present invention.

According to a third aspect of the present invention, there is provided an at least partly polymeric rotor and stator for use in a turbine as defined above.

According to a fourth aspect of the present invention, there is provided a turbine having a turbine housing, an at least partly polymeric stator and optionally an at least partly polymeric rotor, each of the stator and rotor carrying respective turbine blades, wherein the stator is coupled to the turbine housing in an interference fit therewith, to secure the stator against rotation with respect to the housing.

BRIEF DESCRIPTION OF THE SEVERAL VIEWS OF THE DRAWINGS

There follows a detailed description of an embodiment of the present invention, by way of example only, with reference to the accompanying drawings, in which.

DETAILED DESCRIPTION OF THE INVENTION

Figure 1:
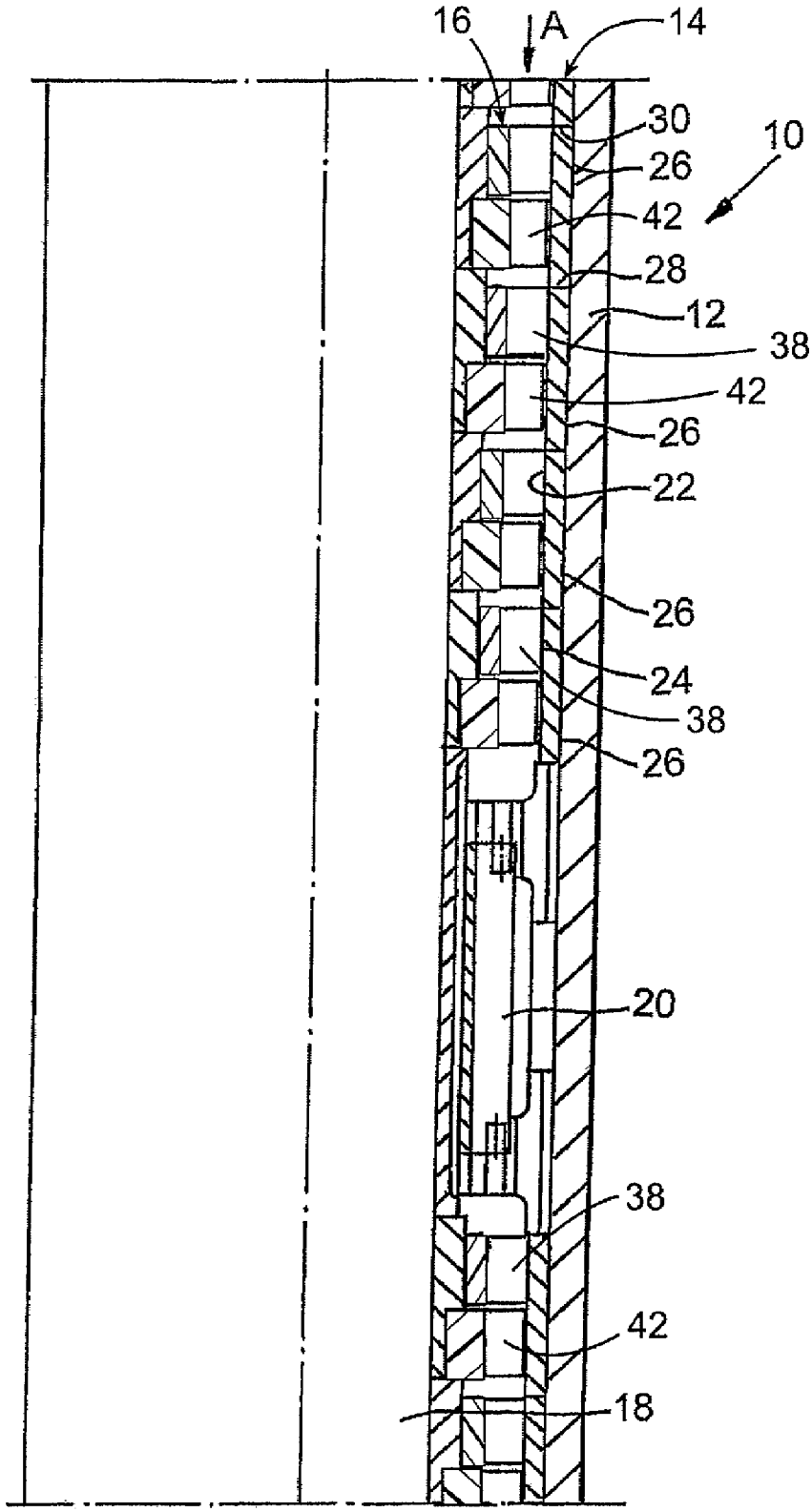
FIG. 1 is a longitudinal half-sectional view of a turbine in accordance with a preferred embodiment of the present invention.

Referring firstly to FIG. 1, there is shown a longitudinal half-sectional view of a turbine in accordance with a preferred embodiment of the present invention, indicated generally by reference numeral 10. The turbine 10 forms part of a drilling assembly (not shown) of a type known in the field of oil and gas well drilling. The turbine is fluid driven by, for example, a drilling mud forced down through the turbine 10, and is used to transfer a rotational drive force to a drill bit (not shown) or the like for fracturing a rock formation to be drilled. The use of turbines in this fashion is well known in the art.

The turbine 10 generally comprises an outer tubular turbine body 12, a turbine blade housing, indicated generally by reference numeral 14, and a turbine blade body, indicated generally by reference numeral 16. The outer turbine body 12 serves for coupling the turbine 10 to other tool assemblies of the drilling assembly by pin and box connections (not shown), in a fashion known in the art. A turbine drive shaft 18 extends through the turbine 10 to transfer rotational motion of the turbine 10 to the drill bit. The turbine 10 also includes a radial bearing assembly 20 to absorb radially directed forces exerted on the turbine 10 in use.

In more detail, the turbine blade housing 14 has an inner facing surface portion 22 of a first material having a first coefficient of expansion, whilst the turbine blade body 16 has an outer facing surface portion 24 of a second material having a second coefficient of expansion, which is greater than the first coefficient of expansion. In particular, the turbine blade housing 14 is of a Nitrided steel or any other suitable hardened steel, whilst the turbine blade body 16 is of a partly polymeric material, as will be discussed in more detail below.

The turbine blade housing 14 actually comprises a number of Nitrided steel shroud rings 26, which are axially aligned within the turbine 10 in a cavity defined between the turbine drive shaft 18 and the outer turbine body 12. The shroud rings are mechanically compressed by a setting assembly (not shown), to force and retain each of the shroud rings 26 in secure abutment with each other. This ensures that faces 28 and 30 of adjacent shroud rings 26 are brought into close abutment, both to secure the shroud rings 26 of the turbine 10 from rotation in use, and to prevent fluid passing between the shroud rings 26 from an inner flow path, indicated by the arrow A, defined between the shroud rings 26 and the turbine drive shaft 18.

Figure 2:
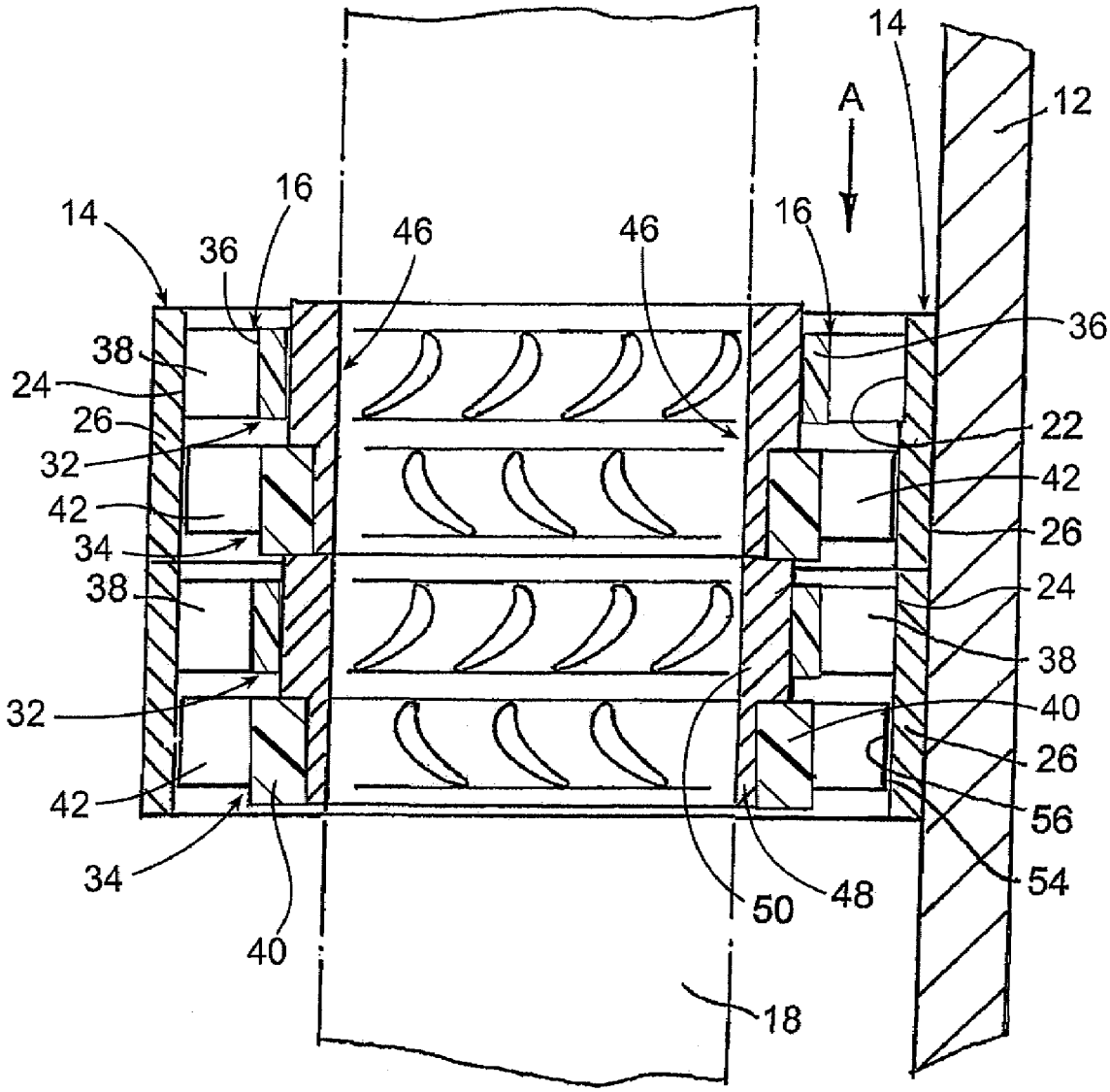
FIG. 2 is an enlarged, partially sectional view of part of the turbine of FIG. 1.
Figure 3A:
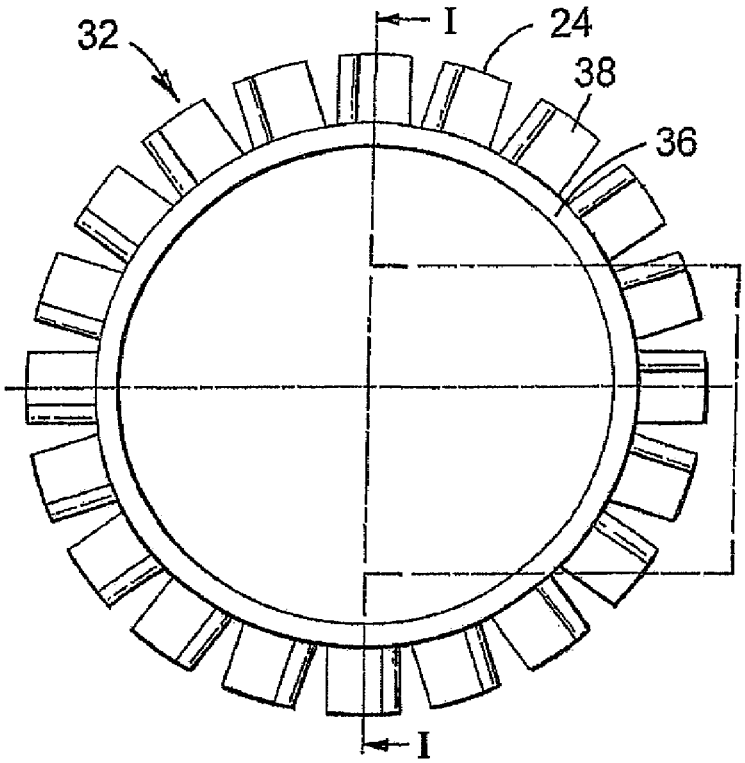
FIG. 3A is a front view of a turbine blade body in the form of a stator, forming part of the turbine shown in FIGS. 1 and 2.
Figure 3B:
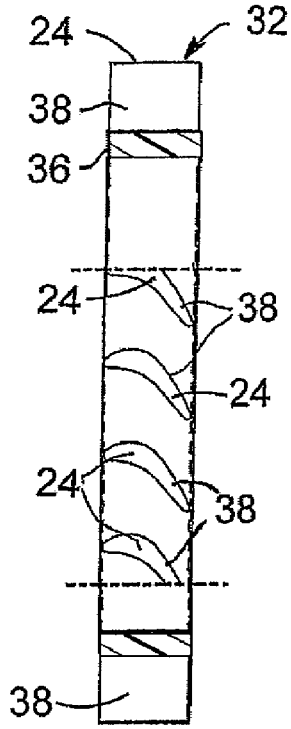
FIG. 3B is a side view of the stator of FIG. 3A, sectioned along line I—I of FIG. 3A.
Figure 4A:
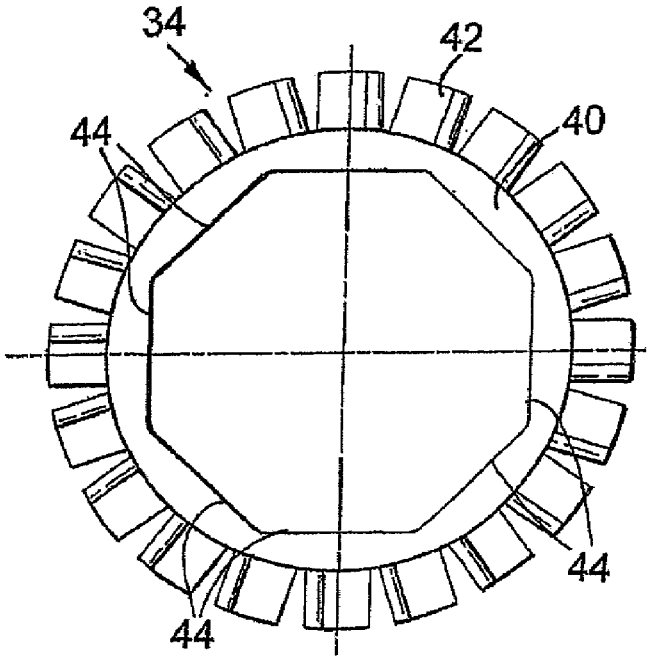
FIG. 4A is a front view of a rotor forming part of the turbine shown in FIGS. 1 and 2.
Figure 4B:
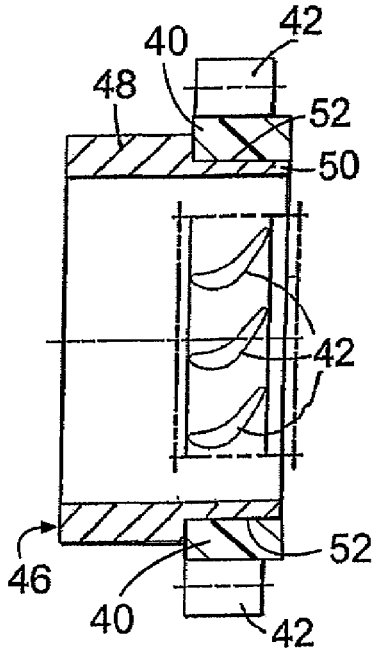
FIG. 4B is a partially sectional side view of the rotor of FIG. 4A.

Turning now to FIG. 2, there is shown an enlarged, partially sectional view of part of the turbine 10 of FIG. 1. In particular, FIG. 2 shows the turbine blade body 16 in more detail. The turbine blade body 16 comprises a number of stators 32, and a number of rotors 34 are provided spaced alternately between the stators 32, as will be described in more detail below. Each shroud ring 26 carries a stator 32 and rotor 34. Referring now also to FIGS. 3A and 3B, there is shown a front view of a stator 32 and a side view of the stator 32, sectioned along line A—A of FIG. 3A, respectively; and to FIGS. 4A and 4B, there is shown a front view of a rotor 34 and a partially sectioned side view of the rotor 34, respectively.

Each stator 32 is in the form of a stator ring, which includes a tubular blade skirt 36 from which a number of stator turbine blades 38 extend. The stator blades 38 are aerodynamically profiled in a fashion known in the art, as shown in particular in FIG. 3B. Each of the stator blades 38 includes an outer edge which defines the outer facing surface portion 24 of the turbine blade body 16 shown in FIG. 1 and described above. Each of the stators 32 are located in a respective shroud ring 26 with the outer facing surface portion 24 disposed against the inner surface of the shroud ring 26, which defines the inner facing surface portion 22 of the turbine blade housing 14. Each of the stators 32 is therefore located in an interference fit with the shroud rings 26, to secure the stators 32 during use against rotation with respect to their respective shroud rings 26.

Locating the stators 32 in their respective shroud rings 26 therefore requires a force to be exerted upon the stator 32, which requires the stator 32 to be of a resilient material. Suitable materials for the stators 32 and rotors 34 will be discussed in more detail below.

Each of the rotors 34 is in the form of a rotor ring and includes a tubular rotor blade skirt 40 from which rotor turbine blades 42 extend. The rotor turbine blades 42 are aerodynamically profiled, in a similar fashion to the stator turbine blades 38 and, as shown in FIG. 2 and noted above, are located alternately between the stators 32. Also, the rotor turbine blades 42 are in an opposite rotational orientation to the stator turbine blades 38, to optimise efficiency of the turbine 10, in a fashion well known in the art. The rotor blade skirt 40 has an inner octagonal profile which defines a number of flats 44. These flats 44 are provided to allow secure engagement of each rotor 34 on a corresponding rotor hub 46, shown in FIG. 4B. Each rotor hub 46 includes a generally tubular portion 48 around which a stator 32 is located, and a shaped portion 50. The portion 50 includes a number of flats 52, corresponding to the flats 44 of each rotor 34, for location of the rotor 34. Furthermore, each of the rotor hubs 46 are mounted on the turbine drive shaft 18, such that when the rotors 34 are driven and rotated by a drilling mud passing along the flow path A and impinging on the rotor blades 42, the hubs 46 and turbine drive shaft 18 are rotated together, to provide a rotational drive force for the drill bit.

As shown in FIG. 2, an annular gap 54 is provided between an outer edge 56 of the rotor turbine blades 42 and the inner portion 22 of each shroud ring 26, to allow the rotors 34 to rotate without the rotor turbine blades 42 coming into contact with the shroud rings 26.

As noted above, the stators 32 and rotor 34 and in particular, the stator and rotor turbine blades 38, 42 are of an at least partly polymeric material, typically a thermoplastic. Typical suitable materials are glass fibre filled nylons (GFFN), such as nylon 6 standard grade BN200 AS and nylon 66, standard grade A216, commercially available from Devol Moulding Services Limited at Loanhead, Midlothian, Scotland; glass fibre filled polyetheretherketones (PEEK), commercially available from Devol Moulding Services Limited under the Trade Mark VICTREX, such as standard grades D450HF30 and D450HT15; and glass fibre filled polyphenylenesulfide (PPS), commercially available from LNP Engineering Plastics.

Typical linear coefficients of expansion for steels are of the order of 1 to $2\times10^{-5}$ $K^{-1}$. For nylon 6, typical coefficients of expansion are of the order of 2.5 to $7\times10^{-5}$ $K^{-1}$, and in particular, $7\times10^{-5}$ $K^{-1}$ for, standard grade BN200 AS nylon 6; for nylon 66, products with a range of 1.5 to $7\times10^{-5}$ $K^{-1}$ for standard grade A216 are available; for PEEK, products with a range of coefficients, typically in the range 3.4 to $13.7\times10^{-5}$ $K^{-1}$, taken at 250° C. and in specific test directions are available; and for PPS, a coefficient of ISO 11359—½× $10^{-5}$ $K^{-1}$ is available.

The applicant has discovered that stator and rotor turbine blades 38 and 42 manufactured from one of these materials withstand high velocity impact erosion, typically experienced in turbines using conventional, steel turbine blades, and furthermore substantially eliminate blade corrosion (due to the chemical composition of the drilling fluid and turbine component molecular structure) as a concern for the turbine blades. Furthermore, such materials have been shown to operate adequately at temperatures in a downhole environment of up to 200° C. The invention has been found to be particularly advantageous in that the stators 32 are securely held against rotation with respect to the shroud rings 26 by the selection of an appropriate material for the shroud ring 26 and the stators 32. The materials are selected such that the material of the stators 32 is of a coefficient of expansion greater than that of the shroud rings 26. This ensures that, at the elevated operating temperatures experienced downhole, the stators 32 seek to expand at a greater rate than the shroud ring 26. In other words, the less dense polymeric based material of the stator 32 is always seeking to expand at a greater rate than the steel shroud ring 26, such that the stators 32/shroud rings 26 are radially and axially self securing at temperature. Furthermore, servicing of the polymer based component parts of the turbine 10 (stators 32 and rotors 34) is readily achievable during overhaul of the turbine 10, by simple mechanical removal and replacement with new stators 32 and rotors 34 where appropriate.

The turbine 10 is also particularly advantageous over existing turbines in that the stators and rotors 32 and 34 are easily injection moulded, or constructed using modern rapid prototyping techniques for constructing complex three-dimensional structures including the outwardly radially positioned aerofoil section stator and rotor turbine blades 38, 40. These blades 38, 40 can be oriented at a desired angle of attack to incoming drilling fluid flowing in the direction of the arrow A of FIG. 1, with a selected blade profile, angle of attack and number of blades predetermined to suit particular drilling conditions.

Various modifications may be made to the foregoing within the scope of the present invention;

The outer facing surface portion of the turbine blade body 16 may comprise a skirt around a plurality of the blades. The rotor skirt 40 and the rotor hub 46 may include any desired number of respective flats 44/52. Any alternative materials may be utilised for the components of the turbine 10, subject to the material of the turbine blade body 16 having a coefficient of expansion greater than that of the turbine blade housing 14. Such may include alternative partly polymeric materials and metals.

It is a further object of the present invention to provide a turbine having a turbine blade body carried by a turbine blade housing, and wherein the turbine blade body is fixed relative to the turbine blade housing by other than fixing means penetrating a side wall of the turbine blade housing. Such fixings cause undesired fluid flow paths.

A particular advantage of the present invention is the reduction of dynamic loading, achieved by constructing the turbine rotors from polymeric/composite materials, this reducing the mass of the rotating elements. This results in a reduction in the axial and transverse vibrational dynamic loading, without the requirement for complicated ancillary mechanical systems. There is also an added axial flexibility in the rotor and stator assembly, where the use of non-metallic (for example, polymeric/composite) materials for the rotor and stator blades reduces the overall stiffness of the rotor and stator stack, allowing the rotor shaft a greater degree of axial flexibility within the body of the turbine casing.

The effect of temperature on the rotor blade tips and stator skirt (due to these parts being of, for example, polymeric/composite materials) helps to reduce power losses by minimising the annular running clearance (between rotor blades/shroud ring and stator skirt/rotor hub or drive shaft), such that the efficiency of the blade system is improved. This may in particular be due to expansion in use reducing the clearance.

A preferred method of manufacturing turbine blades for the turbine is by CNC machining. However, specific blade profiles can be optimised for any desired drilling condition and manufactured by a method known as rapid prototyping by CNC machining.

Selection of, in particular, GFF polymeric composite materials for the rotor and stator blades produces blades which with stand high velocity impact of solids suspended in drilling fluid, which would otherwise cause erosion. The selected materials do not degrade by fluid erosion or corrosion, whilst the efficiency of the aerofoil profile is maintained.

If desired, a secondary bond may be provided between the stator and the shroud rings, for example, by applying an adhesive such as a layer of LOCTITE (trade mark), for example, to the inner diameter of the stator shroud ring, prior to the stator blades being press fitted into the shroud ring. However, the primary method of location of the blades in the shroud ring is by mechanical interference, with enhanced holding in operation by differential expansion between the stator blade and the shroud ring.

That which is claimed:

1. A turbine comprising a turbine blade housing having an inner facing surface portion made of a first metallic material having a first coefficient of expansion, and a turbine blade body made of a second polymeric material having a second coefficient of expansion greater than said first coefficient of expansion, an outer facing surface portion of the turbine blade body being disposed against the inner facing surface portion of the turbine blade housing so as to secure the turbine blade body against rotation with respect to the turbine blade housing.

2. A turbine as claimed in claim 1, wherein the first and second coefficients of expansion are thermal coefficients of expansion of the materials.

3. A turbine as claimed in claim 1, wherein the first and second coefficients of expansion are hydrophilic coefficients of expansion of the materials.

4. A turbine as claimed in claim 1, wherein the outer facing surface portion of the turbine blade body comprises part of one or more of the turbine blades.

5. A turbine as claimed in claim 1, wherein the outer facing surface portion of the turbine blade body comprises a circumferential skirt around a plurality of the turbine blades.

6. A turbine as claimed in claim 1, wherein the turbine blade housing and the turbine blade body are entirely made of said first and second materials respectively.

7. A turbine as claimed in claim 1, wherein the first material is a steel.

8. A turbine as claimed in claim 7, wherein the first material comprises a Nitrided steel and wherein the second material comprises a thermoplastic material.

9. A turbine as claimed in claim 1, wherein the turbine blade body is of a second material comprising a glass fibre filled nylon (GFFN).

10. A turbine as claimed in claim 1, wherein the turbine blade body is of a second material comprising a glass fibre filled polyetheretherketone (PEEK).

11. A turbine as claimed in claim 1, wherein the turbine blade body is of a second material comprising a glass fibre filled polyphenylenesulfide (PPS).

12. A turbine as claimed in claim 1, wherein the turbine is an axial flow fluid driven turbine of a downhole drilling assembly.

13. A turbine as claimed in claim 1, wherein the turbine blade body further comprises a stator, the stator including a stator ring having a tubular blade skirt from which stator turbine blades extend substantially radially outwardly to be disposed against the inner facing surface portion of the turbine blade housing.

14. A turbine as claimed in claim 1, wherein the turbine blade body further comprises a rotor, the rotor including a rotor blade skirt from which rotor turbine blades extend substantially radially outwardly.

15. A turbine as claimed in claim 14, wherein the rotor further comprises a rotor hub on which the rotor skirt is mounted for rotation therewith, the rotor hub forming part of a turbine drive shaft and the rotor skirt including flats for engaging corresponding flats on the rotor hub.

16. A turbine as claimed in claim 15, wherein the rotor skirt and rotor hub include flats arranged in a generally octagonal arrangement.

17. A turbine as claimed in claim 1, wherein the turbine comprises a plurality of stator and rotor rings located alternately along the turbine blade housing.

18. A turbine as claimed in claim 1, wherein the turbine blade housing comprises a number of tubular shroud rings of the second material.

19. A turbine as claimed in claim 18, wherein the shroud rings are restrained against axial and rotational movement by a loading assembly of the turbine.

20. A turbine as claimed in claim 19, wherein the shroud rings are under compression to restrain the shroud rings and to bring opposed seal faces of adjacent shroud rings into sealing abutment.

21. A turbine as claimed in claim 18, wherein each turbine shroud ring carries a stator and a rotor.

22. A turbine as claimed in claim 1, wherein the turbine blade body is disposed against the turbine blade housing in an interference fit.

23. A drilling assembly including a turbine as claimed in claim 1.

* * * * *